US005273283A

United States Patent [19]

Bowland

[11] Patent Number: 5,273,283

[45] Date of Patent: Dec. 28, 1993

[54] GOLF CLUB HEAD WITH SLEEVED CAVITY

[75] Inventor: William R. Bowland, Laurinburg, N.C.

[73] Assignee: Pro Group, Inc., Ooltewah, Tenn.

[21] Appl. No.: 912,828

[22] Filed: Jul. 13, 1992

[51] Int. Cl.[5] ..... A63B 53/08

[52] U.S. Cl. ..... 273/171; 273/173; 273/167 H

[58] Field of Search ..... 273/167-175, 273/77 R, 193 R, 194 R, 194 A, 194 B

[56] References Cited

U.S. PATENT DOCUMENTS

| | | | |
|---|---|---|---|
| 722,011 | 3/1903 | Govan . | |
| 1,213,382 | 1/1917 | Kent . | |
| 1,526,438 | 2/1925 | Scott . | |
| 1,901,562 | 3/1933 | Main . | |
| 2,056,335 | 10/1936 | Wettlaufer . | |
| 2,163,091 | 6/1939 | Held | 273/171 |
| 2,225,930 | 12/1940 | Sexton | 273/171 |
| 2,517,245 | 8/1950 | Scott . | |
| 3,692,306 | 9/1972 | Glover | 273/171 X |
| 3,966,210 | 6/1976 | Rozmus . | |
| 4,043,563 | 8/1977 | Churchwood | 273/171 |
| 4,085,934 | 4/1978 | Churchward | 273/171 |
| 4,206,924 | 6/1980 | Koralik . | |
| 4,511,145 | 4/1985 | Schmidt | 273/167 H |
| 4,534,564 | 8/1985 | Yamada . | |
| 4,695,054 | 9/1987 | Tunstall | 273/173 X |
| 4,749,197 | 6/1988 | Orlowski | 273/167 H X |
| 4,811,949 | 3/1989 | Kobayashi | 273/171 |
| 4,890,840 | 1/1990 | Kobayashi | 273/167 F X |
| 5,042,906 | 8/1991 | Helmstetter | 273/167 H X |
| 5,056,705 | 10/1991 | Wakita et al. . | |

OTHER PUBLICATIONS

"Golf Digest" Magazine, Apr. 1991 Issue, Advertisement for *Big Bertha*, pp. 40-41.

*Primary Examiner*—V. Millin
*Assistant Examiner*—Sebastiano Passaniti
*Attorney, Agent, or Firm*—Wood, Herron & Evans

[57] ABSTRACT

An oversize wooden golf club head has a cylindrical internal cavity which extends upwardly from the bottom of the head, toward but not to its upper surface. A thin-walled, lightweight metal sleeve insert is fitted in this cavity. A sleeve has been found to significantly increase the average distance of drives in comparison to a club head having the cavity but without a sleeve.

17 Claims, 1 Drawing Sheet

GOLF CLUB HEAD WITH SLEEVED CAVITY

FIELD OF THE INVENTION

This invention relates to wooden golf club heads.

BACKGROUND

For many years conventional golf club "woods" were generally of a standard size. Recently "oversized" woods have been made, which provide a larger "sweet spot" and hitting surface, somewhat analogously to oversized tennis racquets. So-called "metal woods", which are not wood but rather are hollow cast in metal, can be made in such larger sizes without greatly increasing their weight. If the traditional solid wood club head is made oversized, however, its weight is undesirably increased and the club is awkward to use. A cavity could be bored or formed in an oversize wooden head to lighten it. However, it has been found that the removal of wood from the interior of an oversize club head which is made of wood substantially reduces its rigidity, which in turn tends to decrease the average distance that a ball can be driven with such a club.

Accordingly, there exists a demand for a wooden wood club head, particularly an oversized wood, of reduced weight, but at the same time with long driving ability.

BRIEF DESCRIPTION OF THE INVENTION

In accordance with this invention an oversize wooden club head is provided with an internal cavity which extends from the lower surface of the head toward, but not to its upper surface. The diameter of the cavity may be approximately $\frac{1}{3}$–$\frac{2}{3}$ of the distance between the front face of the head and its trailing surface, and is preferably about $1\frac{1}{2}$ inches in diameter. A thin-walled strong lightweight metal sleeve insert is fitted in the cavity and is tightly secured to the inside wall of the cavity. The cavity reduces the weight of the head; this sleeve, preferably of titanium, adds some weight but less than was removed by forming the cavity. Heavy metal weights (e.g., lead) may be added to the body rearwardly of the sleeve to increase weight and move the center of gravity rearward, which is preferred. The lower end of the cavity and sleeve is closed by a sole plate, which is secured to the bottom of the head.

Surprisingly, it has been found that provision of the thin-walled lightweight metal sleeve increases the average distance a ball can be hit with the club in comparison to an otherwise similar club having the same size cavity but without the sleeve.

DETAILED DESCRIPTION OF THE INVENTION

Figure 1:
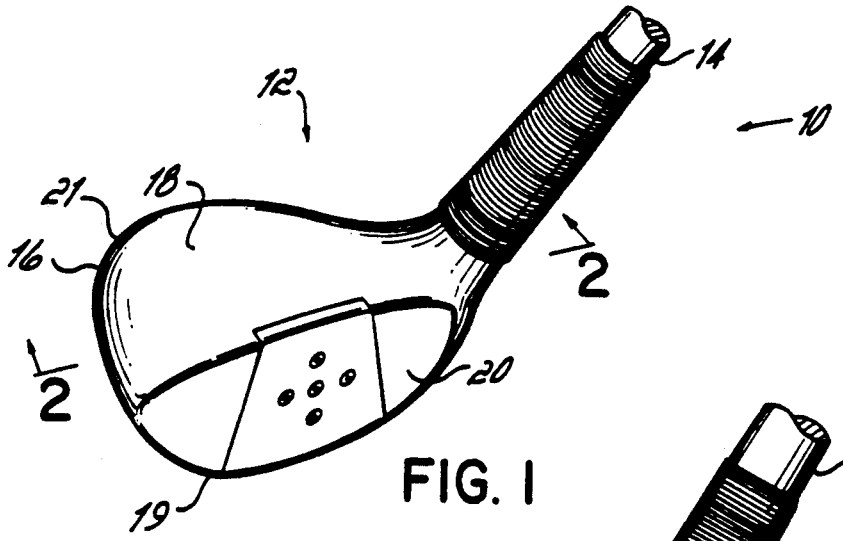
FIG. 1 is a perspective view of a wood club head in accordance with a preferred embodiment of the invention.
Figure 2:
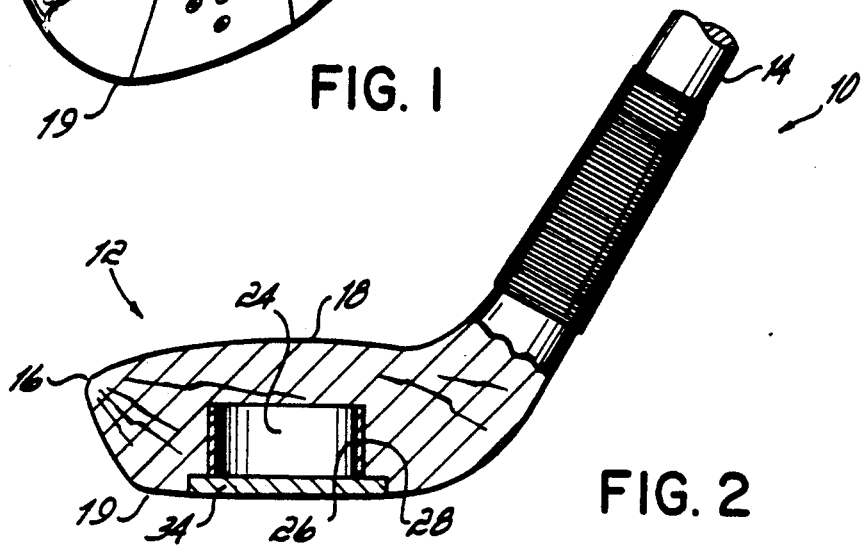
FIG. 2 is an axial section through the club head of FIG. 1 showing the cavity and sleeve.
Figure 3:
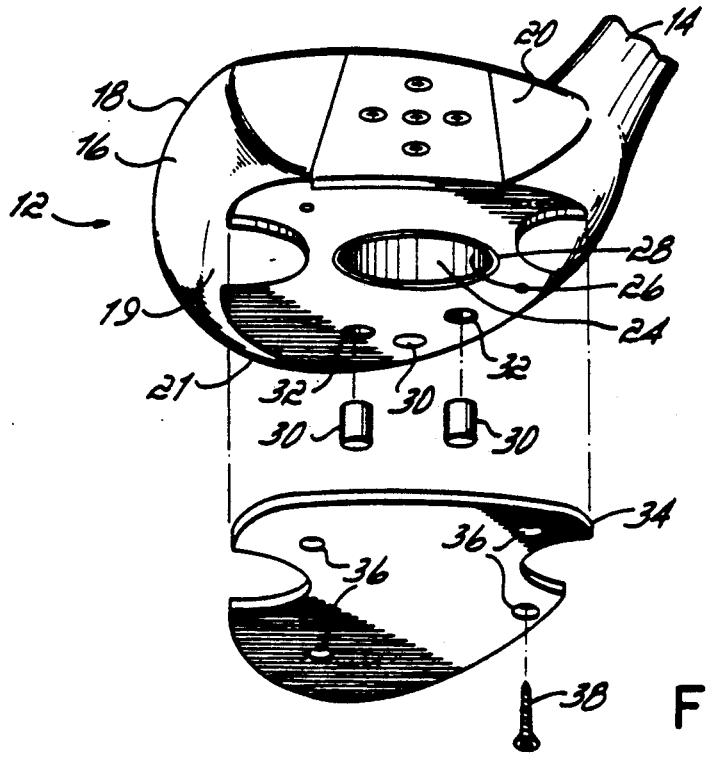
FIG. 3 is an exploded perspective view of the club head showing the manner in which the sole plate fits over the cavity and sleeve.

Referring to FIGS. 1-3, the lower portion of a golf club driver 10 is shown. The golf club 10 has a club head 12 which is mounted to one end of a club shaft 14 by conventional means, such as epoxy glue and a screw (not shown) through the head 12 and into the shaft 14. The club head 12 has an oversized body 16 made of wood, preferably solid persimmon wood. The body 16 has an upper surface 18, a lower surface 19, a front or hitting face 20 and a trailing surface 21. The oversized body 16 is similar in overall shape to a conventional wood, but is preferably about 10–15 percent larger in volume, and most preferably about 12% larger. For example, a typical conventional wood has a dimension from the front 20 to the trailing surface 21 of about 2 63/64 inches, while the corresponding dimension for the oversized body 16 may be about 3 13/64 inches. In addition, a conventional wood has a face 20 that is typically about 2 58/64 inches long and 1 40/64 inches high, while the face 20 for the oversized body 16 may be about 3 20/64 inches long and 1 44/64 inches high. The lower surface 19 of a conventional wood typically has a length of about 2 60/64 inches and a depth of about 2 34/64 inches, while the lower surface 19 of the oversized body 16 may have a length of about 3 16/64 inches and preferred depth of about 2 54/64 inches. The increase in these dimensions increases the club head volume by about 12%.

A cylindrical cavity 24 is formed in the body 16 and extends upwardly from the lower surface 19 toward but not to the upper surface 18, between the front face 20 and the trailing surface 21. Preferably, the cavity 24 has a diameter of about $\frac{1}{3}$ to $\frac{2}{3}$the distance between the front face 20 and the trailing surface 21, most preferably about $1\frac{1}{2}$ inches in diameter. The cavity has a height between about $\frac{1}{3}$ and $\frac{7}{8}$ the distance between the lower surface 19 and upper surface 18, most preferably about 1 inch. In order to maintain the structural integrity of the head 16, the cavity 24 should not be formed near the hitting face 20, but rather should be centered approximately half-way between its front and back surfaces.

A strong, thin-walled lightweight metal sleeve insert 26, preferably made of titanium, industrial grade 2, ASTM B338, is dimensioned to fit snugly in the cavity. Preferably, the sleeve insert 26 is a short length of tube, for example, having a length of about 1 inch, an outside diameter of about 1.5 inches and a wall thickness of about 0.034–0.036 inches. The sleeve insert 26 is preferably tightly secured to the inside wall 28 of the cavity 24 with an adhesive in order to help prevent the sleeve insert 26 from moving or rattling in the cavity 24. One or more heavy metal weights 30 can be mounted in bores 32 in the club head body 16 in order to move the center of gravity rearward in club head 12. If more than one bore 32 is provided, they are preferably spaced apart along a curve paralleling the trailing surface 21. Each bore 32 is preferably cylindrical and has an axis generally parallel to the central axis of the cavity 24 which extends between the lower surface 19 and upper surface 18. Preferably, the weight 30 is formed by filling the appropriate bore 32 with lead particles suspended in a hardenable epoxy matrix.

The lower surface 19 of head 12 is adapted to receive a sole plate 34 for covering the cavity 24 and bores 32. The sole plate 34 has a plurality of countersunk holes 36, each of which receives a screw 38 to secure the sole plate 34 to the lower surface 19 of the body 16 and enclose the sleeve insert 26 and metal weight 30 in the club head body 16.

The oversized club head 12 provides a larger "sweet spot" and hitting surface on front face 20, as compared to a standard wood club driver. Moreover, by forming the cavity 24 in the oversized body 16, the undesirable increase in weight associated with such an oversized wooden club head 12 is eliminated. However, test data has shown that the provision of such a cavity 24, without more, produces relatively poor hitting characteristics. It is believed that the removal of wood from the interior of the club head 12 significantly reduces its rigidity, which in turn tends to decrease the average distance a ball can be hit with such a club. Surprisingly, however, by fitting the thin walled, lightweight metal sleeve insert 26 securely in the cavity 24, the lost rigidity is regained, with only a slight increase in the weight of the head 12. By making the cavity 24 cylindrical, stresses transmitted through the club head body 16 when the front face hits a ball are apparently more evenly distributed around the inside wall 28 of the cavity 24. Thus, the head 12 is less likely to crack compared to some other cavity configurations.

The lead weights 30 are used to bring the golf club driver 10 to a desired finished swing weight. For a properly finished swing weight, it is desirable and preferred for the center of gravity of the club head 12 to be shifted rearward of the sleeve insert 26; for this purpose the lead weights 30 are positioned in the body 16 rearwardly of the sleeve insert 26.

Test results have shown that the present golf club driver 10 surprisingly increases the average distance a ball can be hit in comparison to an otherwise similar club having the same size cavity 24 but not having a sleeve insert. Referring to the Table below, test results have also shown that the present golf club driver 10 increases the average distance a ball can be hit in comparison to other commercially available golf club drivers. An automatic golf club hitting device manufactured by True Temper Corporation under the trademark "Iron Byron" was used to insure a consistent stroke for each golf club tested. A total of 48 balls were hit by each golf club during these tests. The term "drive" as used in the Table refers to the distance traveled by the ball from the point of impact. The "off-center average" refers to the average distance a given ball deviated from a desired centerline.

TABLE

| | DRIVER COMPARISONS | | | |
|---|---|---|---|---|
| | LONGEST DRIVE | SHORTEST DRIVE | AVERAGE DRIVE | OFF-CENTER AVERAGE DRIVE |
| Present Driver | 280 Yds. | 245 Yds. | 263.7 Yds. | 6.8 Yds. |
| Commercial Driver #1 | 263 Yds. | 238 Yds. | 252.5 Yds. | 5.8 Yds. |
| Commercial Driver #2 | 257 Yds. | 235 Yds. | 243.2 Yds. | 19.1 Yds. |
| Commercial Driver #3 | 269 Yds. | 240 Yds. | 253.9 Yds. | 11.5 Yds. |
| Commercial Driver #4 | 243 Yds. | 225 Yds. | 234.7 Yds. | 11.2 Yds. |
| Commercial Driver #5 | 272 Yds. | 240 Yds. | 258.9 Yds. | 8.0 Yds. |

From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

What is claimed is:

1. A golf club head comprising:

a body made of wood, said body having an upper surface, a lower surface, a front face, and a trailing surface, a cylindrical cavity formed in said body between said face and said trailing surface, said cavity having a wall and extending upwardly from said lower surface toward but not to said upper surface, a sleeve insert fitted in said cavity, said insert being of a lightweight metal and having an outer surface which closely adjoins the wall of said cavity, and a sole plate secured to the lower surface of said body and extending across and closing said cavity, the presence of said sleeve in said cavity increasing the average distance a ball can be hit with said club, in comparison to a similar club having said cavity but without said sleeve insert.

2. The golf club head of claim 1 wherein the height of said cavity is between about $\frac{1}{3}$ and $\frac{2}{3}$ the distance between said lower surface and said upper surface.

3. The golf club head of claim 1 wherein the diameter of said cavity is about $\frac{1}{3}$ to $\frac{2}{3}$ the distance between said front face and said trailing surface of said body.

4. The club head of claim 1 wherein said sleeve insert has a wall thickness between about 0.034–0.036 inches.

5. The club head of claim 1 wherein at least one heavy metal weight is mounted in said body rearwardly and outside of said cavity.

6. The golf club head of claim 5 wherein multiple weights are mounted in bores in said head, said bores being cylindrical and having axes generally parallel to a center axis of said cavity.

7. The golf club head of claim 6 wherein said bores are spaced apart along a line generally paralleling said trailing surface.

8. The golf club head of claim 1 wherein said body is about 10 to 15% larger in volume than a conventional wood club driver.

9. The golf club head of claim 1 wherein said lightweight metal is titanium.

10. The golf club head of claim 1 wherein said body is of persimmon wood.

11. The golf club head of claim 1 wherein said sleeve is adhesively secured to the wall of said cavity.

12. The golf club head of claim 1 wherein said head is a driver.

13. A golf club head comprising:

a body made of wood, said body having an upper surface, a lower surface, a front face, and a trailing surface, a cylindrical cavity formed in said body between said face and said trailing surface, said cavity extending upwardly from said lower surface toward but not to said upper surface, a sleeve insert fitted in said cavity, said insert being of a lightweight metal having an outer surface which closely adjoins the wall of said cavity, at least one heavy metal weight being mounted in said body rearwardly and outside of said cavity, and a sole plate secured to the lower surface of said body and covering said cavity.

14. The golf club head of claim 13 wherein said at least one weight is mounted in a bore formed in said head, said bore being cylindrical and having an axis generally parallel to a center axis of said cavity.

15. The golf club head of claim 14 wherein each said bore is located along a line generally paralleling said trailing surface.

16. The golf club head of claim 13 wherein said lightweight metal is titanium.

17. The golf head of claim 13 wherein said sleeve insert has a wall thickness within the range of approximately 0.034–0.036 inches.

* * * * *

UNITED STATES PATENT AND TRADEMARK OFFICE

CERTIFICATE OF CORRECTION

PATENT NO. : 5,273,283

DATED : December 28, 1993

INVENTOR(S) : William R. Bowland

It is certified that error appears in the above-indentified patent and that said Letters Patent is hereby corrected as shown below:

Column 4, Line 16, "2/3" should read --7/8--.

Column 4, Line 65, "golf head" should read --golf club head--.

Signed and Sealed this

Fifth Day of July, 1994

Bruce Lehman

*Attest:*

BRUCE LEHMAN

*Attesting Officer*

*Commissioner of Patents and Trademarks*